US005940427A

United States Patent [19]

Hürtgen et al.

[11] Patent Number: 5,940,427

[45] Date of Patent: Aug. 17, 1999

[54] CRUCIBLE INDUCTION FURNACE WITH AT LEAST TWO COILS CONNECTED IN PARALLEL TO A TUNED CIRCUIT CONVERTER

[75] Inventors: Reinhold Hürtgen, Simmerath; Thomas Frey, Stolberg, both of Germany

[73] Assignee: Otto Junker GmbH, Germany

[21] Appl. No.: 08/702,447

[22] PCT Filed: Mar. 18, 1996

[86] PCT No.: PCT/DE95/00376

§ 371 Date: Nov. 21, 1996

§ 102(e) Date: Nov. 21, 1996

[87] PCT Pub. No.: WO95/26619

PCT Pub. Date: Oct. 5, 1995

[30] Foreign Application Priority Data

Mar. 25, 1996 [DE] Germany ..... 44 10 436

[51] Int. Cl.[6] ..... H05B 6/06

[52] U.S. Cl. ..... 373/150; 373/139; 373/148

[58] Field of Search ..... 373/138, 139, 373/144, 146, 147, 148, 149, 150, 152

[56] References Cited

U.S. PATENT DOCUMENTS

| | | | |
|---|---|---|---|
| 1,631,667 | 6/1927 | Beckmann | 373/147 |
| 1,795,136 | 3/1931 | Northrup | 373/150 |
| 1,943,802 | 1/1934 | Northrup | 373/149 |
| 3,331,909 | 7/1967 | Kasper | 373/152 |

*Primary Examiner*—Tu Ba Hoang
*Attorney, Agent, or Firm*—Shook, Hardy & Bacon L.L.P.

[57] ABSTRACT

A coreless induction furnace includes a vertical melting crucible defining a melting chamber having upper and lower chamber portions and at least two coils. A first one of the coils is disposed so as to surround the upper chamber portion and a second one of said coils is disposed so as to surround the lower chamber portion. The furnace also includes a single-phase load-commutated oscillation circuit converter, a plurality of capacitors and an electrical circuit system electrically connecting the coils, the capacitors and the converter. The electrical interconnection is such that the first one of the coils is electrically connected in series with a first one of the capacitors having a first capacitvie impedance to thereby present a first oscillation circuit, and the second one of the coils is electrically connected in series with a second one of the capacitors having a second capacitive impedance to thereby present a second oscillation circuit. The electrical interconnection is also such that the converter, the first oscillation circuit, the second oscillation circuit and a third one of the capacitors having a third captive impedance are all connected in parallel relative to one another. In one aspect of the disclosure, the capacitive impedance of at least one of the first and second capacitors may be selectively varied. In another aspect of the disclosure, the furnace may include an on-off switch connected in series with at least one of the first and second coils.

4 Claims, 2 Drawing Sheets

CRUCIBLE INDUCTION FURNACE WITH AT LEAST TWO COILS CONNECTED IN PARALLEL TO A TUNED CIRCUIT CONVERTER

CROSS REFERENCE TO RELATED APPLICATION

The present application has been filed pursuant to the provisions of 35 U.S.C. Sec. 371 as a national stage application of international application PCT/DE95/00376 filed on Mar. 18, 1995. Priority is claimed pursuant to 35 U.S.C. Sec 119 from German Application filed on Mar. 25, 1994.

BACKGROUND OF THE INVENTION

1. Field of the Invention

The invention relates to a crucible induction furnace with at least two coils, which are connected in parallel to a load-commutated tuned circuit converter, run round the wall of a vertical melting crucible, are disposed one behind the other along the axis of the crucible and are connected in series with a capacitive impedance.

2. Description of The Prior Art

It is a universally known practice, when melting metals in a crucible induction furnace of the type stated above, to use induction coils to generate eddy currents in the material to be melted and thereby heat the metal. The melting power transmitted by a coil increases with the magnitude and frequency of a voltage applied to the coil. In order to be able to operate with higher frequencies than the mains frequency, use is generally made of tuned circuit converters, to the secondary side of which the induction coils are connected. However, the level of the secondary voltage in the case of tuned circuit converters is limited due to the tolerance to voltage of the semiconductor components.

It is furthermore common practice to increase the voltage applied to the coils of a crucible induction furnace by connecting a capacitive impedance in series with mutually parallel induction coils to the secondary side of a tuned circuit converter.

The purpose of the upstream capacitive impedance is to bring the tuned circuit into the resonant oscillation range. To explain its action, an ideal series tuned circuit with a coil of inductance L, a capacitor of capacitance C and a vanishing resistance is considered below. In this case, the following equation applies to the resonant frequency $f_0$:

$$f_0 = 1/\sqrt{L \cdot C} \quad \text{(I)}$$

If a tuned circuit of this kind is operated with an operating frequency f and an operating voltage $U_1$, the voltage $U_2$ in accordance with the equation:

$$U_2 = U_1/(1-(f/f_0)^2) \quad \text{(II)}$$

can be picked off between the input and the output of the coil.

In the circuit described above belonging to a crucible induction furnace and corresponding to the prior art, the same voltage is applied to all the coils. Such a circuit arrangement makes sense when the power requirement is the same at all the coils.

BRIEF SUMMARY OF THE INVENTION

Often, however, it is advantageous to supply different areas of the crucible with different power densities. Thus, for example, it is the object of DE 563 710 to supply the material to be melted with a power density which decreases or increases in the axial direction in order to influence the movement of the melt bath.

Another example of a differing power requirement in different areas of the crucible is provided by a crucible which is only partially full, as is the case, for example, during the charging of the crucible or, possibly, where the quantity of the material to be melted is less than the maximum possible. Here, those coils which surround an empty part of the crucible cannot transmit any power to the melt.

Where a coil surrounds the filled part of a crucible, the material to be melted acts like a core of the coil, and almost all types of materials to be melted reduce the inductance of the coil. Such a reduction in the inductance effects an increase in the resonant frequency $f_0$ in the corresponding tuned circuit in accordance with equation (I).

If, in this case, consideration is given, for example, to a crucible induction furnace with two coils of identical construction, the crucible of which is approximately half full, the lowered inductance of the lower coil has the effect of a higher resonant frequency relative to the upper coil. Since, when using a parallel tuned circuit converter, the operating frequency is somewhat above the resulting resonant frequency of the overall tuned circuit system, i.e. above the resonant frequencies of the individual tuned circuits, the lower individual tuned circuit in the above example is operated closer to its resonant frequency than the upper one. Consequently, the voltage present between the input and the output of the coil and hence also the maximum possible power output in the lower individual tuned circuit is higher than in the upper individual tuned circuit.

In the case of a crucible content which, in contrast to the above example, increases the inductance of a coil, it is likewise possible, in accordance with what has ben stated above, to bring about a desired power distribution by employing a series tuned circuit converter, the operating frequency of which is somewhat below the resulting resonant frequency of the overall system.

However, apart from the filling level of the crucible, power distribution effected solely by means of the material to be melted is dependent only on the physical properties of the material to be melted. The foregoing results are achieved through the use of a crucible induction furnace according to the invention wherein the furnace has at least two coils, which are connected in parallel to a load-commutated tuned circuit converter, run round the wall of a vertical melting crucible, are disposed one behind the other along the axis of the crucible and are connected in series with a capacitive impedance, wherein each coil, is assigned a separate capacitive impedance and the resulting individual tuned circuits are connected in parallel, in that the converter is a parallel tuned circuit converter and in that a capacitive impedance is connected in parallel with the individual tuned circuits.

As regards the precharacterizing clause of claim 1, the prior art therefore has the disadvantage, in particular, that, where a single capacitive impedance is used for a number of induction coils connected in parallel, the voltage across the coils is in each case the same and adaptation to the actual power requirement in the region of the respective coil is not possible.

The object on which the invention is based is to be able, by simple means, to establish effective distribution of the power output by a tuned circuit converter between the individual coils.

In the case of a crucible induction furnace of the above-mentioned type, this is achieved by virtue of the fact that each individual coil is assigned a separate capacitive impedance and the resulting individual tuned circuits are connected in parallel, that the converter is a parallel tuned circuit converter and that a capacitive impedance is connected in parallel with the individual tuned circuits.

This has the effect that an appropriate voltage and hence power consumption can be established at each coil as a function of the capacitance and inductance—also dependent on the filling level—of its tuned circuit. Individual tuned circuits with a low power requirement are then operated outside their resonant frequency and individual tuned circuits with a high power requirement are operated at resonance.

The crucible induction furnace according to the invention can furthermore be designed in such a way that the capacitance of at least one of the capacitive impedances can be varied.

Possible capacitive impedances are capacitor units made up of a single capacitor or of a plurality of capacitors and, if required, switching elements. By means of switching elements, the individual capacitors can be connected up in different ways, allowing the total capacitance of the capacitor unit to be set at different values depending on requirements.

A variable capacitance has the advantage that the resonant frequency of an individual tuned circuit can be adapted to possibly varying process conditions, e.g. during crucible charging and also during furnace operation.

Finally, the crucible induction furnace according to the invention can be configured in such a way that an on-off switch is connected in series with at least one of the coils.

This allows individual coils to be cut off completely from the power supply when required, something which may be worthwhile in the case of furnaces with three or more coils.

BRIEF DESCRIPTION OF THE VIEW OF THE DRAWINGS

An embodiment of the crucible induction furnace according to the invention and its effect on the power supply will now be described in greater detail with reference to drawings, in which.

DETAILED DESCRIPTION OF THE INVENTION

Figure 1:
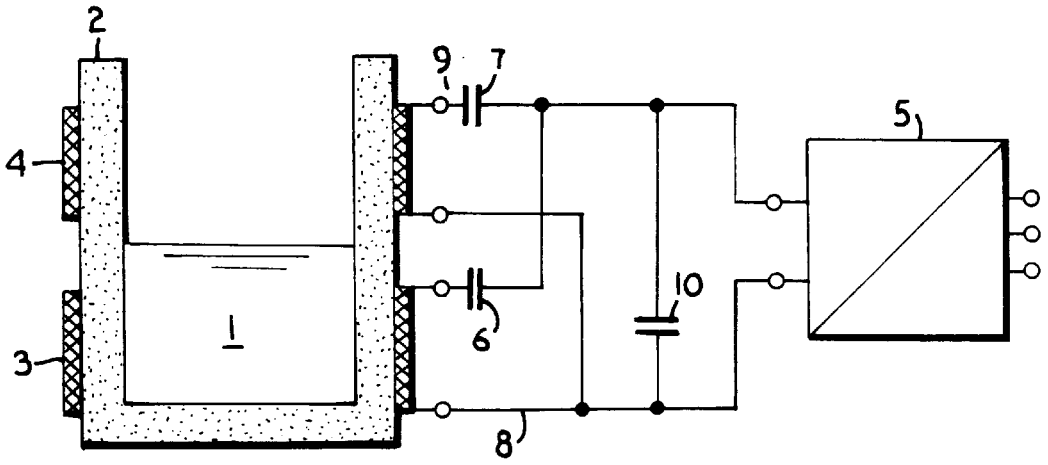
FIG. 1 shows a crucible induction furnace with two individual tuned circuits connected in parallel with a tuned circuit converter.

FIG. 1 shows a crucible induction furnace, the crucible 2 of which, which is only half filled with material to be melted 1, is surrounded by two coils 3, 4. Respective capacitors 6, 7 are connected in series with each coil 3, 4, thus giving rise to two separate individual tuned circuits 8, 9. These are connected to a parallel tuned circuit converter 5. A capacitor 10 connected in parallel with the individual tuned circuits 8, 9 is used for power factor correction. The lower individual tuned circuit 8 surrounds a part of the crucible 2 which is filled with material to be melted 1, while the upper individual tuned circuit 9 surrounds an empty part of the crucible. The selected capacitances of the circutes 8, 9 are equal. At the filling level of the crucible shown in FIG. 1, the resonant frequency of the lower individual tuned circuit 8 is closer to the operating frequency of the tuned circuit converter 5 than the resonant frequency of the upper individual tuned circuit 9. From this it follows that the power output by the coils 3, 4 is concentrated on the part of the crucible 2 which is filled with material to be melted 1.

Figure 2:
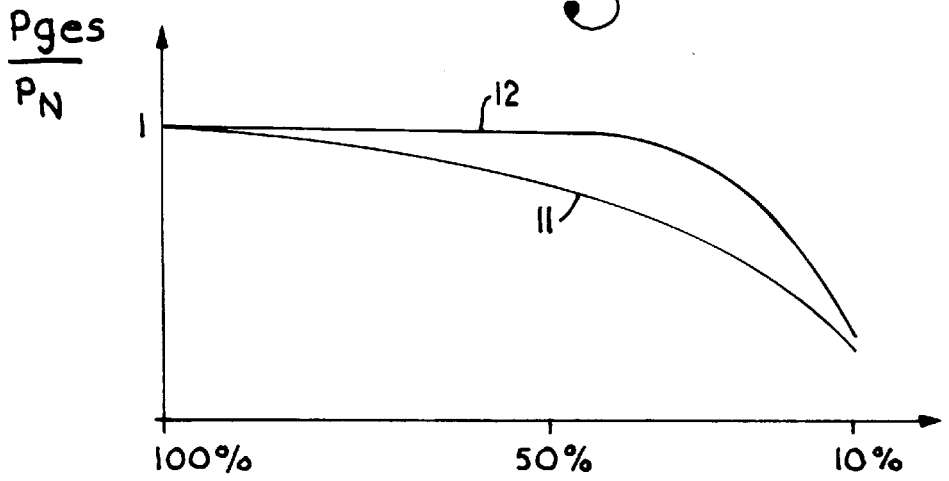
FIG. 2 shows a diagram to illustrate the power consumption—dependent on the filling level of the crucible—of a crucible induction furnace according to the invention in comparison with the prior art.

In addition to the favourable distribution of the power, the crucible induction furnace according to the invention brings about a higher power consumption by the furnace itself in comparison with the prior art, when the crucible 2 is not completely full. This state of affairs is illustrated in the diagram in FIG. 2.

The ratio of the total power actually consumed by the crucible induction furnace $P_{GES}$ to the rated power of the furnace $P_N$ is plotted on the ordinate, and the crucible filling level in percent is plotted on the abscissa. The curve 11 shows the power ratio $P_{GES}/P_N$ as a function of the crucible filling level for a crucible induction furnace, the individual coils of which are connected in parallel in accordance with the prior art. According to this, the power consumption falls as soon as the crucible filling level falls below 100%.

Curve 12, in contrast, shows the corresponding power ratio in the case of a crucible induction furnace according to the invention. It can be seen that, up to a crucible filling level of significantly below 50%, the power ratio is virtually constant at $P_{GES}/P_N$ 1. Only at a crucible filling level of less than 10% do the two curves 11, 12 approach one another again. The crucible induction furnace according to the invention thus also effects an increase in the power consumed by the furnace when the crucible 2 is not completely full, this power being transmitted to the material to be melted 1.

Figure 3:
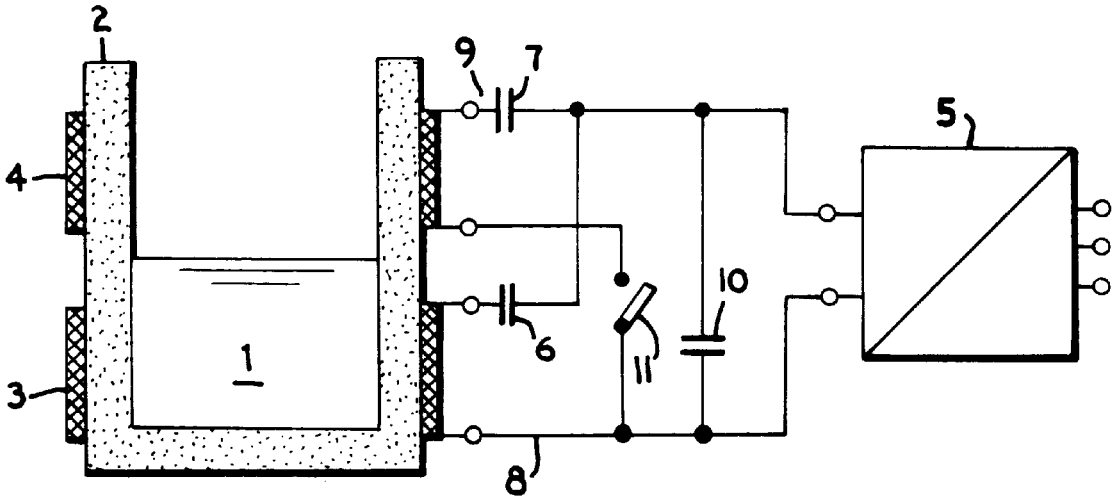
FIG. 3 shows a crucible induction furnace which is the same as the furnace of FIG. 1 except that an on-off switch is included in circuit 9.

FIG. 3 shows a crucible induction furnace which is the same as the furnace of FIG. 1 except that an on-off switch has been added in circuit 9 in series with the coil 4. As indicated above, this allows coil 4 to be cut off completely from the power supply when desired. As would be readily appreciated by those of ordinary skill in the art, a switch such as the switch 11 could also be included in circuit 8. Alternatively, a switch such as the switch 11 could be included in both circuit 9 and circuit 9.

| Reference numerals | |
|---|---|
| 1 | Material to be melted |
| 2 | Crucible |
| 3 | Coil |
| 4 | Coil |
| 5 | Tuned circuit converter |
| 6 | Capacitor |
| 7 | Capacitor |
| 8 | Individual tuned circuit |
| 9 | Individual tuned circuit |
| 10 | Capacitor |
| 11 | Power output of the tuned circuit converter |
| 12 | Power output of the tuned circuit converter |

We claim:

1. A coreless induction furnace comprising:

a vertical melting crucible defining a melting chamber having upper and lower chamber portions;

at least two coils, a first one of said coils being disposed so as to surround the upper chamber portion and a second one of said coils being disposed so as to surround the lower chamber portion;

a single-phase load-commutated oscillation circuit converter;

a plurality of capacitors; and an electrical circuit system electrically connecting said coils, said capacitors and said converter so that said first one of said coils is electrically connected in series with a first one of said capacitors having a first capacitive impedance to present a first oscillation circuit, so that said second one of said coils is electrically connected in series with a second one of said capacitors having a second capacitive impedance to present a second oscillation circuit, so that said converter, said first oscillation circuit, said second oscillation circuit and a third one of said capacitors having a third capacitive impedance are all connected in parallel relative to one another.

2. A coreless induction furnace as set forth in claim 1, wherein the capacitive impedance of at least one of said first and second capacitors can be selectively varied.

3. A coreless induction furnace as set forth in claim 1, wherein is included an on-off switch connected in series with at lest one of said first and second coils.

4. A coreless induction furnace as set forth in claim 2, wherein is included an on-off switch connected in series with at least one of said first and second coils.

* * * * *

UNITED STATES PATENT AND TRADEMARK OFFICE

CERTIFICATE OF CORRECTION

PATENT NO. : 5,940,427
DATED : August 17, 1999
INVENTOR(S) : Reinhold Hurtgen and Thomas Frey It is certified that error appears in the above-identified patent and that said Letters Patent is hereby corrected as shown below:

Title page,
Item [22], PCT Filed:, delete "1996" and insert -- 1995 -- therefor.
Item [30], Foreign Application Priority Data, delete "1996" and insert -- 1994 -- therefor.

Signed and Sealed this

Sixth Day of August, 2002

*Attest:*

*Attesting Officer*

JAMES E. ROGAN
*Director of the United States Patent and Trademark Office*